US006880815B2

(12) United States Patent
Jäger

(10) Patent No.: US 6,880,815 B2
(45) Date of Patent: Apr. 19, 2005

(54) APPARATUS FOR AERATING WATER

(75) Inventor: Arnold Jäger, Burgdorf (DE)

(73) Assignee: Gummi-Jäger KG GmbH (DE)

( * ) Notice: Subject to any disclaimer, the term of this patent is extended or adjusted under 35 U.S.C. 154(b) by 105 days.

(21) Appl. No.: 10/446,255

(22) Filed: May 28, 2003

(65) Prior Publication Data

US 2003/0222359 A1 Dec. 4, 2003

(30) Foreign Application Priority Data

May 28, 2002 (DE) ..... 102 23 805

(51) Int. Cl.[7] ..... B01F 3/04

(52) U.S. Cl. ..... 261/122.1; 261/122.2; 261/124

(58) Field of Search ..... 261/62, 122.1, 261/122.2, 124

(56) References Cited

U.S. PATENT DOCUMENTS

| | | | | | |
|---|---|---|---|---|---|
| 2,415,048 | A | * | 1/1947 | Sharp | 261/124 |
| 2,502,187 | A | * | 3/1950 | Wahlgren | 261/122.1 |
| 2,781,310 | A | * | 2/1957 | Ram et al. | 210/205 |
| 2,815,943 | A | * | 12/1957 | Lamb | 261/122.1 |
| 2,978,234 | A | * | 4/1961 | Lamb | 261/122.1 |
| 3,063,689 | A | * | 11/1962 | Coppock | 239/602 |
| 3,080,124 | A | * | 3/1963 | Rathmann | 239/450 |
| 3,186,644 | A | * | 6/1965 | Ross et al. | 239/533.13 |
| 3,206,178 | A | * | 9/1965 | Lamb | 239/145 |
| 3,219,520 | A | * | 11/1965 | Box | 204/622 |
| 3,315,895 | A | * | 4/1967 | Klingbeil et al. | 239/145 |
| 3,432,154 | A | * | 3/1969 | Danjes | 261/122.2 |
| 3,490,752 | A | * | 1/1970 | Danjes et al. | 261/122.1 |
| 3,603,509 | A | * | 9/1971 | Nechine | 239/145 |
| 3,642,260 | A | * | 2/1972 | Danjes et al. | 261/122.1 |
| 3,841,997 | A | * | 10/1974 | McGee | 210/622 |
| 3,880,965 | A | * | 4/1975 | Dudis et al. | 261/122.1 |
| 4,060,486 | A | * | 11/1977 | Schreiber | 210/220 |
| 4,118,447 | A | * | 10/1978 | Richter | 261/122.1 |
| 4,243,616 | A | * | 1/1981 | Wyss | 261/122.1 |
| 4,379,750 | A | * | 4/1983 | Tiggelbeck | 210/232 |
| 4,960,546 | A | * | 10/1990 | Tharp | 261/122.1 |
| 5,032,325 | A | * | 7/1991 | Tharp | 261/124 |
| 6,619,633 | B1 | * | 9/2003 | Jager et al. | 261/122.2 |
| 2002/0109247 | A1 | * | 8/2002 | Jager et al. | 261/122.2 |

FOREIGN PATENT DOCUMENTS

| | | | | |
|---|---|---|---|---|
| DE | 3639473 | * | 5/1988 | 261/122.2 |
| DE | 3700038 | * | 7/1988 | 261/122.2 |
| DE | 10203780 | * | 9/2003 | 261/122.2 |

* cited by examiner

*Primary Examiner*—Richard L. Chiesa
(74) *Attorney, Agent, or Firm*—Robert W. Becker & Associates; Robert W. Becker

(57) ABSTRACT

An apparatus for aerating water or other liquid is provided, and includes a flexible hose of rubber or other elastomeric material for disposal in the water or other liquid. The wall of the hose has a perforation, fine slits, openings or the like via which gas can escape into the liquid. A tubular connector is introduced into one end of the hose via which air can be supplied to the hose. That end of the tubular connector facing the interior of the hose has a flattened configuration and extends in the direction of the longitudinal axis of the hose. The wall of the tubular connector is provided with apertures for the passage of air.

10 Claims, 2 Drawing Sheets

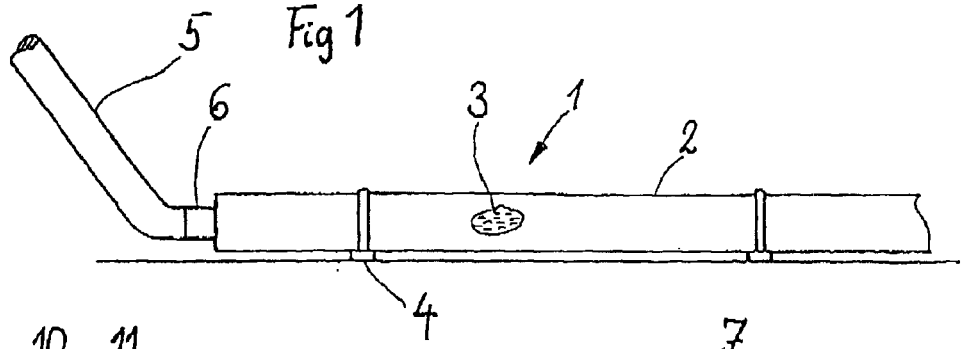
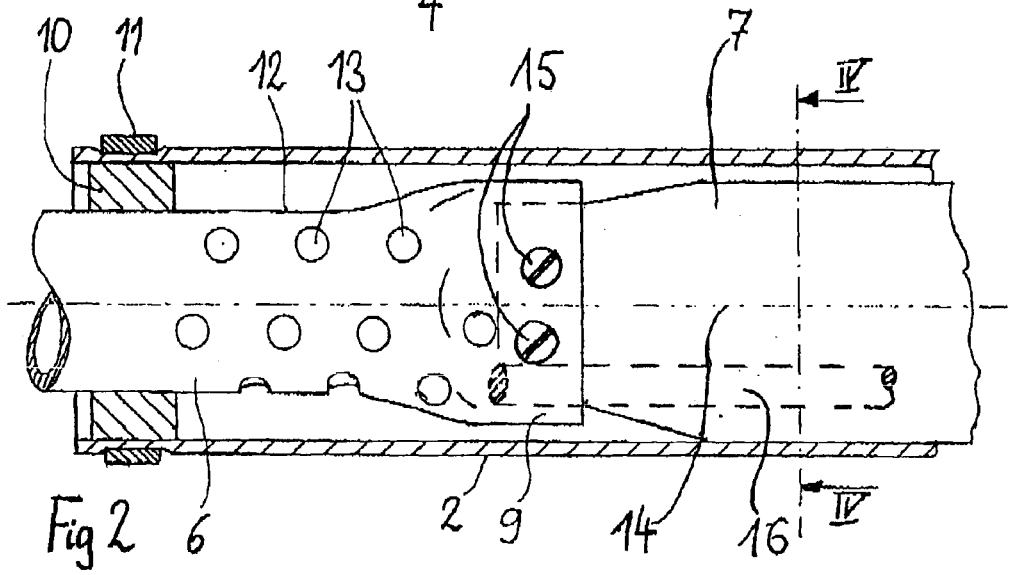
Fig 2
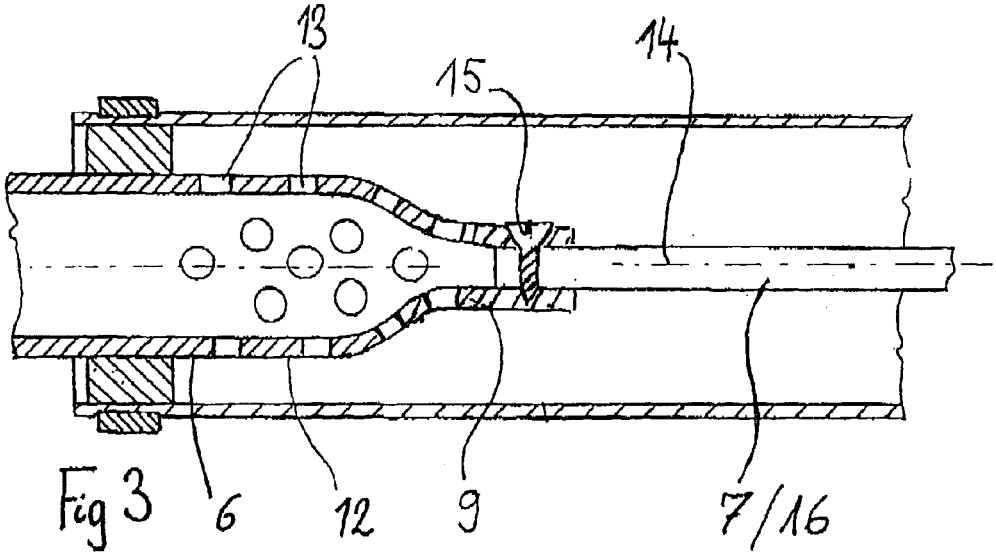
Fig 3

APPARATUS FOR AERATING WATER

BACKGROUND OF THE INVENTION

The present invention relates to an apparatus for aerating water, and includes a flexible hose of rubber or a rubber-like material that can be disposed in the water and the wall of which is provided with a perforation, fine slits, openings, or the like via which the air can escape into the water, whereby a tubular connector is introduced into one end of the hose, and air can be supplied to the hose via the tubular connector.

With a known, frequently used water aerator, the hose is disposed on a support tube (see, for example, DE 37 00 038 C2). The hose has a slightly larger diameter than does the support tube. The air is conveyed between the support tube and the hose. The air expands the hose and raises it from the support tube. In this connection, the slits in the hose open, and the air escapes into the water. When the apparatus is in a state of rest and is not supplied with compressed air, the hose is supported upon the tube and the slits are again closed.

To simplify the construction of the water aerator, but also for it to be more flexible during installation in the environment in which gas is to be introduced, which environment can, for example, be a clarifying or settling tank, or also an open, natural body of water having irregular, "soft" boundaries, and finally also in order to reduce the flow resistance of the air within the aerator, apparatus of the aforementioned type have been proposed according to which a support tube is eliminated (German patent application DE 102 03 780.9, which was not yet published at the time of the filing of the priority application corresponding to this application). Also with these apparatus, a reinforcing element that extends parallel to the hose is associated therewith to prevent too great of a deformation, especially a bending, of the hose as a consequence of water flows and buoyancy, and hence an adverse effect upon the introduction of gas. Such a reinforcing element can be secured to the outside on the hose, for example in the form of a profiled element. However, the reinforcing element can also be disposed within the hose, whereby its circumference, in contrast to the support tube described above, is, however, significantly less than the circumference of the hose. Such an element can, for example, be a round rod. A particularly advantageous reinforcing element is one of a solid, yet flexible material in the form of a strip or slat having a flat, rectangular cross-section, and which is disposed within the hose in such a way that the longer sides of the cross-section are vertical or upright. This element offers high rigidity against deformation due to buoyancy forces, yet permits horizontal movements and deformations of the hose as a consequence of water flows without resulting in bending that is too sharp. With these aeration elements, when the hose is in a state of rest, and is not supplied with compressed air, it is pressed flat together by the pressure of the surrounding water, and is thus sealed relative to the penetration of water.

With the above-described apparatus with a support tube, the supply of air is effected by a tubular connector that is inserted into the open end of the hose, whereby the tubular connector and the support tube have the same diameter, and the hose is fixedly clamped upon the connector by means of a clamp (DE 37 00 038 C2). A corresponding manner of construction would lead to problems for an apparatus not having a support tube due to the flat pressing-together of the hose in a state of rest. A transition zone would be formed between the cylindrical portion formed by the tubular connector and the flat portion; in this transition zone, portions of the hose would be subjected to high mechanical stresses, especially due to bending or deflection at the edges of the tubular connector. Furthermore, there is no seal in this transition zone in a state of rest, so that it must remain free of slits, and thus cannot be used for aeration.

It is therefore an object of the present invention, for an apparatus of the aforementioned general type, to provide a connection for the air supply in a form that is suitable for the type of construction where no support tube is provided.

BRIEF DESCRIPTION OF THE DRAWINGS

This object, and other objects and advantages of the present invention, will appear more clearly from the following specification in conjunction with the accompanying schematic drawing, in which:

FIG. 1 shows one exemplary embodiment of an inventive water aerator;

FIG. 2 is a longitudinal cross-sectional view through a portion of an inventive apparatus as seen from the side;

FIG. 3 is a longitudinal cross-sectional view of the apparatus of FIG. 2 but shown rotated, about the longitudinal axis, by 90°.

SUMMARY OF THE INVENTION

Figure 4:
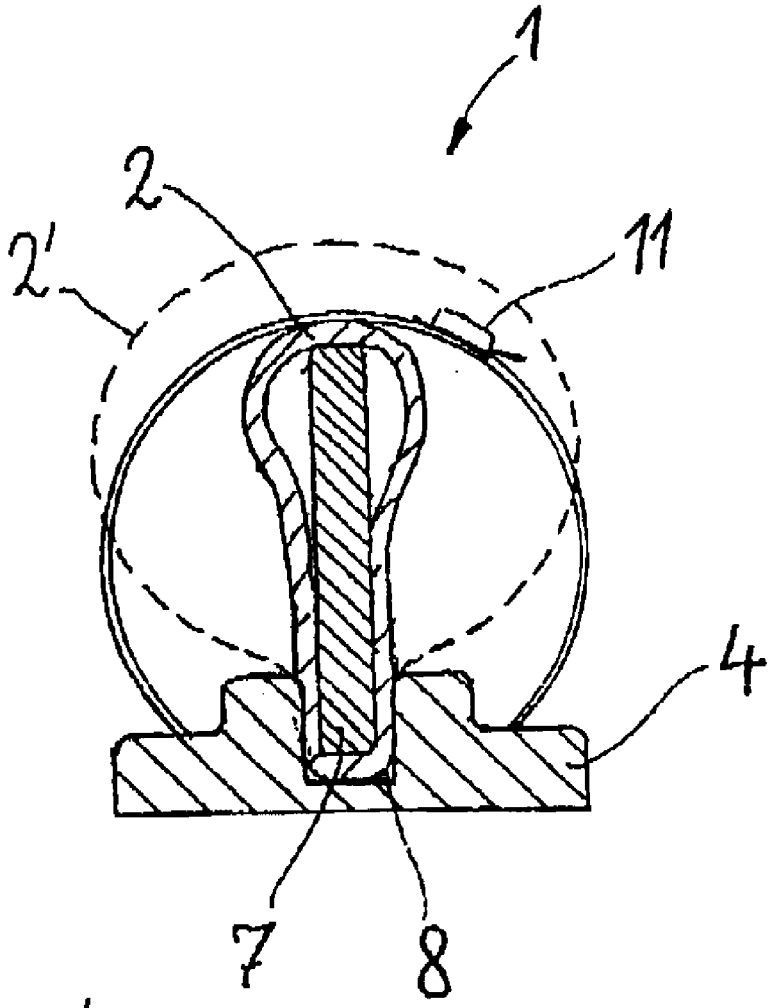
FIG. 4 is a cross-sectional view taken along the line IV—IV in FIG. 2.

The water aerator of the present invention realizes the foregoing object in that that end of the tubular connector that faces the interior of the hose is embodied as a flattened portion and extends in the direction of the longitudinal axis of the hose, and in that the walls of the tubular connector are provided with apertures to allow air to pass through.

As a consequence of the present invention, the transition from the cylindrical portion to the flattened portion is provided on the tubular connector itself. In a state of rest, the walls of the hose rest partly upon the tubular connector and partly upon the support member and/or against oppositely disposed wall portions, without thereby leading to a sharp deflection at an edge. With the present invention, the tubular connector is preferably arranged in such a way that its flat end is disposed upright or vertically. In a particularly advantageous manner, the tubular connector is used together with a flat, slat-like support member that is disposed in the hose, since as a consequence of this support member the shape of the hose is prescribed in the non-pressurized state, so that undesired deformations can be avoided in the transition zone.

In a straightforward manner, the tubular connector can be produced from a tube, the end of which is pressed flat while being subjected to plastic deformation. It has been shown to be particularly advantageous to carry out the plastic deformation only to such an extent that a slot remains for receiving the reinforcing element. A slat-like support member can be introduced into this slot. If the support member and the tubular connector are screwed together, or are fixedly connected in some other manner, for example by an adhesive, one obtains a connection of the element that prevents, or at least makes more difficult, a turning or twisting of the elements relative to one another.

Pursuant to another advantageous embodiment of the invention, a round rod can also be used in place of the aforementioned slat-like support member as the reinforcing element. The rod is introduced into the bottom of the vertical or upright slot of the tubular connector. The rod can also be screwed, adhesively connected, or be fixedly connected in some other manner with the connector. The rod is preferably made of metal or glass-fiber reinforced polymeric material.

Pursuant to another advantageous embodiment of the invention, the diameter of the tubular connector is less than the diameter of the hose, and the hose is secured to the tubular connector via a ring that serves as a spacer. This embodiment is advantageous because the flat, pressed end of the tubular connector has a width that is greater than the diameter of the tube of the connector. The hose can be guided over this wide end without deformation, and can be well and reliably secured at a distance from the wide end. This embodiment is furthermore advantageous because the longer portion of the tubular connector can be inserted into the end of the hose. Since the end of the tubular connector, due to its flat configuration, is essentially closed off, the transport of air is effected via the apertures in the wall of the tubular connector. A plurality of apertures can be provided on the longer portion of the tubular connector, thereby enabling a good supply of air to the aerating element, with such supply of air encountering a low flow resistance.

It is also within the scope of the present invention to dispose a plurality of aerating elements in connection with one another, for example parallel to one another. Although the foregoing description has been primarily directed to air and water, it is to be understood that the inventive apparatus is also suitable for the transport of other gases, such as oxygen, and that the apparatus can be utilized to introduce gas not only into water, but also into other liquid or essentially liquid media.

Further specific features of the present invention will be described in detail subsequently.

DESCRIPTION OF PREFERRED EMBODIMENTS

Referring now to the drawings in detail, the water aerator 1 essentially comprises a tube or a hose 2 that can be disposed in the liquid into which gas is to be introduced. The hose 2 is made of an elastic material, especially of a rubber or a rubber-like polymeric material. The hose is provided with fine slits, which are indicated by the reference numeral 3 for a portion of the surface of the hose. Holding means 4 serve for the securement of the water aerator 1 to the base of a reservoir or tank, which accommodates the liquid into which gas is to be introduced, or on carrier means or the like that can be introduced into the liquid, or also for the mounting of floats, if the water aerator 1 is to be disposed in the water in a freely floating manner.

Compressed air can be supplied to the water aerator 1 via a line 5. Under the influence of the compressed air, the hose 2 expands to an essentially cylindrical body, which is illustrated by the dashed line 2' in FIG. 4. The slits open, and the air can escape into the environment. In this connection, the slits are disposed only on the side regions of the hose 2, while the uppermost and lowermost regions of the hose are free of slits.

The hose 2 can have a great length, possibly of several meters. Disposed in the interior of the hose 2 is a reinforcing element 7 that has a flat, essentially rectangular cross-section, and thus has the shape of a slat, a bar or a rigid strip. The reinforcing element 7 is made of a solid, yet somewhat flexible material, for example polymeric material. The reinforcing element 7 extends over the entire length of the hose 2. For very long hoses, a plurality of reinforcing elements 7 could be disposed one after the other. When viewed in cross-section, the element 7 is disposed upright, and together with the hose 2 is held in a clamping manner in grooves 8 of the holding means 4 (see FIG. 4).

A tubular connector 6 serves for a connection between the feed line 5 and the hose 2; the connector 6 is inserted into one end of the hose 2. The opposite, non-illustrated end of the hose 2 is closed off in an airtight manner. The tubular connector 6 comprises a tube of metal or polymeric material. The diameter of the tubular connector 6 is considerably less than the diameter of the hose 2. Pursuant to one exemplary embodiment of the present invention, the diameter of the hose 2 is 75 mm, and the diameter of the tubular connector 6 is 65 mm. One end of the hose 2 is secured to the tubular connector 6, for which purpose a ring 10 is inserted as a spacer between the hose 2 and the tubular connector 6. The tubular connector 6, the ring 10 and the hose 2 are arranged concentrically relative to one another. The end of the hose 2 is held on the ring 10 by being clamped thereto via a bracket or clamp 11. In the event that the clamping force of the clamp 11 is not adequate to seal off the entire connection, it is possible, especially between the tubular connector 6 and the ring 10, to dispose sealing means or to provide an adhesive, welding or fusing, or other type of connection.

A relatively longer cylindrical portion 12 of the tubular connector 6 extends over a long portion of its length, is disposed within the hose 2, and is delimited toward the outside by the ring 10. The portion 12 is provided with apertures 13 via which the air can pass from the feed line 5 into the hose 2. Due to the large length of the portion 12, a number of apertures 13, and hence a large overall cross-section, can be provided for the transfer of the air. The portion of the length of the hose 2 that surrounds the portion 12 of the connector 6 is not provided with any slits in order to avoid a direct transfer of air.

The flat portion 9 of the tubular connector 6 is disposed vertically, and extends in the direction of the longitudinal axis 14 of the hose 2. Its inner dimensions correspond approximately to the outer dimensions of the bar or reinforcing element 7. Due to the flat portion 9, a progressive transfer to the bar 7 is provided.

The bar 7 and the tubular connector 6 are interconnected in such a way that the front end of the bar 7 extends into the flattened portion 9 of the connector 6. The bar 7 and the tubular connector 6 are connected by the screws 15. A connection of the bar 7 with the tubular connector 6 can also be established in an adhesive manner, by rivets, with a pin, or in some other suitable manner. Instead of the bar 7, a rod 16 could also be used as a reinforcing element, as shown by dashed lines in FIG. 2. The surface of the flattened portion 9 that is not filled by the rod 16 is, in this case, used for the supply of the air.

FIG. 3 illustrates the hose 2 in a form that it approximately assumes during operation. If in a state of rest the compressed air is reduced, the hose 2 is pressed flat against the bar or reinforcing element 7 by the pressure of the surrounding water as is illustrated in FIG. 4 by the solid lines. The hose 2 rests against the tubular connector 6, whereby due to the smooth transitions sharp kinks and considerable stretching are avoided. In this connection, it should be noted that although a bending or deflection of the hose is possible at the ring 10, this bending is too slight to lead to adverse effects, and furthermore, since the hose 2 is not provided with slits in this region, no sealing or leak problems are caused.

The specification incorporates by reference the disclosure of German priority document 102 23 805.7 filed 28 May 2002.

The present invention is, of course, in no way restricted to the specific disclosure of the specification and drawings, but also encompasses any modifications within the scope of the appended claims.

I claim:

1. An apparatus for aerating water or other liquid, comprising:

a flexible hose of rubber or other elastomeric material for disposal in water or other liquid, wherein said hose is provided with openings via which gas can escape into said liquid; and a tubular connector introduced into an end of said hose, wherein said tubular connector is adapted to receive air, wherein said tubular connector is provided with apertures to allow air to pass through and be conveyed to said hose, and wherein an end of said tubular connector facing an interior of said hose is embodied as a flattened portion and extends in the direction of a longitudinal axis of said hose.

2. An apparatus according to claim 1, wherein said tubular connector is comprised of a tube, said end of which is flattened.

3. An apparatus according to claim 1, wherein said tubular connector has an outer diameter that is less than an inner diameter of said hose, and wherein said hose is secured to the outer periphery of a ring that surrounds said tubular connector.

4. An apparatus according to claim 3, wherein said inner diameter of said hose is greater than an outer diameter of said end of said tubular connector.

5. An apparatus according to claim 3, wherein said hose is pressed against said ring by means of a tubular clamp.

6. An apparatus according to claim 1, wherein said flattened end of said tubular connector is disposed in an upright manner.

7. An apparatus according to claim 1, wherein a reinforcing element is disposed in said hose, wherein said reinforcing element extends in the direction of said longitudinal axis of said hose and has a flat cross-section, and wherein said reinforcing element and said flattened end of said tubular connector are disposed in a single plane and are aligned with one another.

8. An apparatus according to claim 7, wherein said flattened end of said tubular connector is deformed for receiving said reinforcing element.

9. An apparatus according to claim 7, wherein said reinforcing element extends into said tubular connector.

10. An apparatus according to claim 8, wherein said reinforcing element is connected with said tubular connector via fastening means.

* * * * *